United States Patent [19]

Henderson et al.

[11] Patent Number: 4,649,828

[45] Date of Patent: Mar. 17, 1987

[54] EXPLOSIVELY FORGED PENETRATOR WARHEAD

[75] Inventors: David Henderson, Yarmouthport; Chang-Sheng Ting, Lexington, both of Mass.

[73] Assignee: Avco Corporation, Wilmington, Mass.

[21] Appl. No.: 826,586

[22] Filed: Feb. 6, 1986

[51] Int. Cl.[4] ..... F42B 11/22

[52] U.S. Cl. ..... 102/476; 102/306; 102/501

[58] Field of Search ..... 102/306–310, 102/476, 475, 492, 495, 384, 501

[56] References Cited

U.S. PATENT DOCUMENTS

| | | | |
|---|---|---|---|
| 2,763,210 | 9/1956 | Church et al. | 102/307 |
| 4,356,770 | 11/1982 | Atanasoff et al. | 102/384 |
| 4,492,166 | 1/1985 | Purcell | 102/384 |
| 4,538,519 | 9/1985 | Witt | 102/306 |

*Primary Examiner*—Harold J. Tudor

*Attorney, Agent, or Firm*—Abraham Ogman; Robert J. McNair

[57] ABSTRACT

An ordnance device includes a submunition having a generally cylindrical case packed with an explosive charge. The rearmost end of the case is capped by a detonator that fires the explosive charge when a target is sensed. The front end of the case is capped by a liner that on detonation of the explosive charge converts to one or more explosively forged penetrators that speed toward the target at supersonic speed. By assembling the liner from a plurality of narrow metal strips arranged in parallel and weakly bonded together, the strips separate on detonation forming a plurality of aerodynamically stable slugs, each of which has undergone plastic deformation to form a projectile that is potentially lethal.

4 Claims, 7 Drawing Figures

*Fig. 5.*
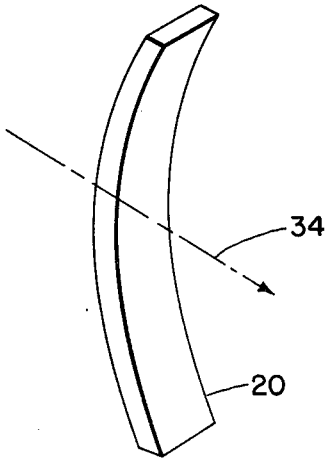
*Fig. 6.*
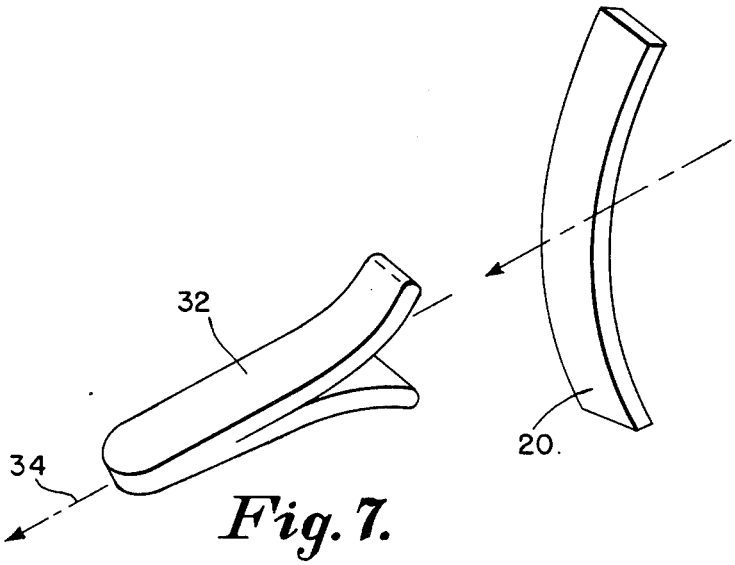
*Fig. 7.*

EXPLOSIVELY FORGED PENETRATOR WARHEAD

BACKGROUND OF THE INVENTION

This invention generally pertains to ordnance devices including submunitions which search an area and, from a long standoff range, utilize an explosively forged penetrator type warhead to attack an armor protected target.

The U.S. Pat. No. 4,356,770 to Atanasoff et al having the same assignee as this invention discloses a munitions system wherein a cylindrical cannister is fired over a target. A spinning motion is imparted to the cannister in order to stabilize its flight. The cannister carries a target sensing infrared device and, when a target is detected, a projectile is fired downward from the bottom of the overflying cannister.

The U.S. Pat. No. 4,492,166 to Purcell discloses another overflying submunition having an infrared detector which scans a target area and provides a terminal trajectory correction capability to enhance target interceptions. In both the Purcell and Atanasoff et al patents, the forward end of the explosive warhead is capped with a parabolic Misznay-Schardin disc. The warhead formed from the explosively forged Misznay-Schardin disc is capable of penetrating armor.

The armor perforation capability of the explosively formed penetrator (EFP) made from the Misznay-Schardin discs is marginal for the new generation of harder armored vehicles. Our invention substantially increases the lethality of an EFP warhead by maximizing slug momentum density on the target. Slug momentum density is directly proportional to both the impact velocity and the slug length component of the velocity vector.

SUMMARY OF THE INVENTION

This invention improves the lethality of explosively formed penetrator (EFP) warheads at long standoff ranges by formation of aerodynamically stable slugs, each of whose length dimension greatly exceeds its width.

Typically, a complete submunition includes a steel cylindrical case filled with explosives (for example, 75/25 Octol). At the rear of the case there is a detonator mechanism and a booster. The front end of the case is capped by a shaped metal disc called a liner. The Misznay-Schardin disc of the prior art warhead was parabolic and concave inward. For implementing our invention, we make the liner of either copper, soft iron or high density metal.

In our implementation, the liner is not made from a single continuous sheet of metal. Rather, a multiplicity of narrow strips are arranged parallel to each other. For example, to make a five inch diameter disc, (recognizing that shapes other than circular may be more desirable) five strips each one inch wide are laid side by side in a plane and secured one to the other as by epoxy. From this five inch wide assembly, a circular disc is cut and shaped in a press prior to insertion in the warhead case. To produce a seven inch diameter disc, seven one inch wide strips can be used. Similarly, a five inch diameter disc can be formed from seven strips each 0.714 inches wide.

As viewed from the side, the assembled disc appears parabolic in cross section and is positioned concave inward into the case. Using a properly shaped explosive charge, each of the multiplicity of parallel strips is forged into an outwardly directed slug using a center line detonation front. Each strip is forged so that it folds in the middle while undergoing thermally activated plastic flow. Unlike typical EFP's therefore, only the middle of the strip experiences extreme strain. Plastic deformation creates slugs which are aerodynamically stable and four to five times as long as they are wide.

The longer slug length for equivalent packaged volume provides better target penetration performance than prior art warheads. Additionally, due to the higher configurations, the warheads can be detonated at greater standoff ranges. Further, the probability of delivering a lethal strike is increased since a multiplicity of high-Mach-number slugs are delivered instead of the one EFP projectile when using a Misznay-Schardin disc.

BRIEF DESCRIPTION OF THE DRAWINGS

FIG. 5 is a perspective view of the center strip of the FIG. 3 liner assembly.

FIG. 6 is a perspective view of the FIG. 5 liner strip immediately after detonation of the warhead explosive.

FIG. 7 is a perspective view of the explosively forged penetrator formed from the FIG. 5 strip.

DETAILED DESCRIPTION OF THE PREFERRED EMBODIMENT

Figure 1:
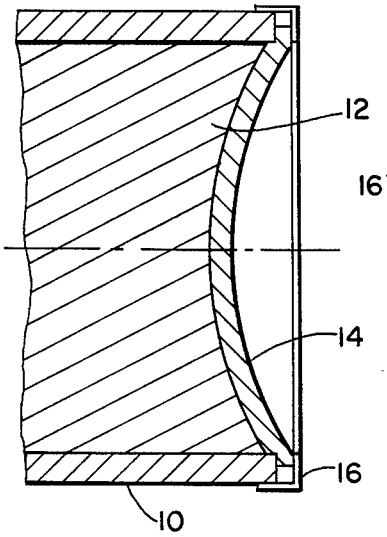
FIG. 1 is a cross sectional view of the forward end of a prior art cylindrical explosive warhead.
Figure 2:
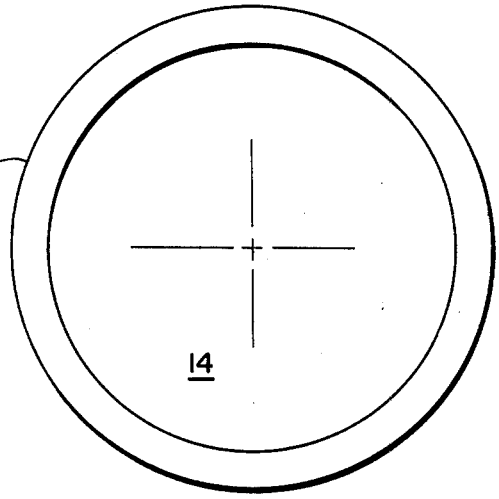
FIG. 2 is an end view of the parabolic disc which caps the warhead of FIG. 1.

FIGS. 1 and 2 show the forward end of a cylindrical explosive warhead which may be a part of an overflying munitions device such as that disclosed in U.S. Pat. No. 4,356,770. The warhead shown in FIGS. 1 and 2 includes case 10, an explosive charge 12, a parabolic shaped disc 14 and a keeper ring 16. When the explosive charge 12 is detonated, disc 14 is forged into a projectile capable of penetrating armor plate. Sensors in the overflying munitions device aim the projectile at a selected target from a distance known as the standoff range. The EFP warhead formed from the explosive collapse of disc 14 generates an elongated slug which is launched at supersonic velocity toward the target. Our invention improves the lethality and aerodynamic stability of the EFP warheads.

Figure 3:
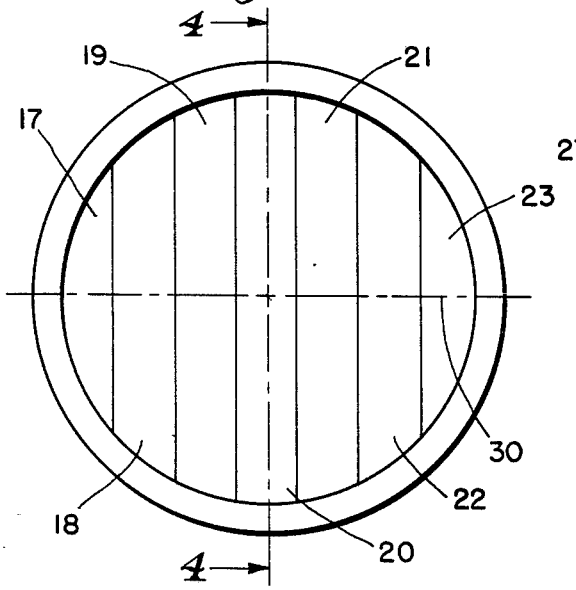
FIG. 3 is an end view of the liner which caps the warhead of this invention.
Figure 4:
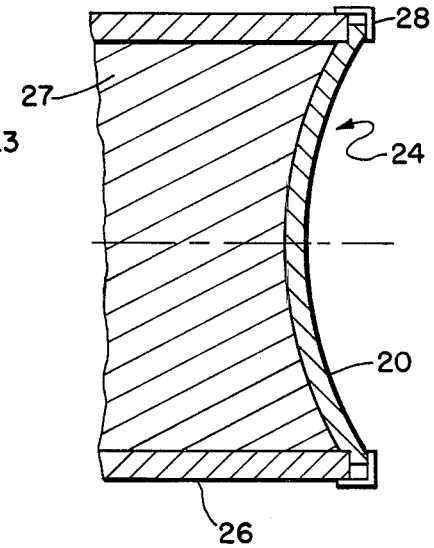
FIG. 4 is a cross sectional view of the forward end of the warhead taken along line 4—4 of FIG. 3.

FIGS. 3–7 show how this is accomplished. FIG. 3 shows an end view of a warhead liner 24 comprised of seven parallel strips 17–23. The center strip 20 of this assemblage is very nearly seven times as long as it is wide. To make a five inch diameter liner 24 having a finished mass of 550 g, seven strips of appropriate material each five inches long and 0.715 inches wide were positioned side by side in a fixture and pressed into the parabolic shape shown in FIG. 4. In the pressed condition the assemblage was then epoxied together and the resulting 5×5 in. plate shaped as shown in FIG. 3. Warhead liner 24 was then secured to the end of cylindrical steel case 26 (see FIG. 4). Keeper ring 28 maintains warhead liner 24 in place. Detonation of explosive charge 27 propels the several strips making up warhead liner 24 rapidly outward. By properly configuring the detonation booster end of the explosive charge 27, a centerline detonation front can be made to advance outward all along centerline 30 (see FIG. 3).

A centerline detonation pressure wave front forges each of the strips 17–23 into a separate EFP projectile. This is because the bonding agent between strips is essentially weak and crystalline with respect to the explosive forces being applied. Calculation shows that for a five inch diameter liner 24 configured as shown in FIG. 3 and having an overall mass of 550 g, the weight of the individual strips will be as follows:

strip 17=48.4 g=strip 23
strip 18=81.8 g=strip 22
strip 19=95.4 g=strip 21
strip 20=98.8 g As seen in the above tabulation, the two strips adjacent center strip 20 are within 3.4 percent as long in size. Even strips 18 and 22 are 82.8 percent as long as center strip 20. Only outside strips 17 and 23 end up being only about half or full size. As such, all can be explosively forged into lethal armor penetrating slugs.

FIGS. 5, 6 and 7 depict the forging process. FIG. 3 shows the center strip 20 as it appears in the undetonated warhead condition. Arrowhead 34 points in the direction strip 20 will move when the explosive charge is detonated. From the side, strip 20 has a parabolic contour. In FIG. 6 strip 20 is shown as it appears a few microseconds after centerline initiation of the explosive charge. The center of the strip has moved outward due to greater acceleration at the midpoint and the ends have started to fold back. The end result of the forging action is shown in FIG. 7. The strip experiences a temperature rise of several hundred degrees due to adiabatic heating. A higher temperature rise occurs at the center and results in plastic deformation that causes elongation. Slug 32 of FIG. 7 is more than half the length of the original strip 20. Further lengthening is achieved by controlling the velocity gradient along the length of the folded strip thus increasing L/D by inducing axial plastic strain. Tests instrumented by making multiple flash X-ray recordings at locations 9 in, 3 ft, 12 ft and 25 ft down range from the EFP warhead can show the formation of slug 32 as it speeds away from the detonated casing 26 shown in the cross sectional view of FIG. 4.

It will be understood that the detonation of the explosive charge creates the forging of not one but a multiplicity of the FIG. 7 slugs 32. For the parallel strip arrangement shown in FIG. 3, there will be seven EFP slugs formed simultaneously with all speeding at supersonic velocity toward the target more or less abreast and diverging as required.

Our invention can be implemented using combinations having more ot less than seven parallel strips and more than one array of strips facing other directions for more effective utilization of the explosive charge.

Also, the embodiment described thus far mentions the use of copper strips. It is to be understood the warhead liner 24 (see FIGS. 3 and 4) can be formed from soft iron or other suitable high density materials. Tests and analyses made to date show that material grain size, hardness and liner thickness influence the flow stress, plasticity and formation of aerodynamically stable slugs.

In summary, the slim strip EFP utilizes narrow rectangular pieces of metal assembled in a side by side array as by brazing or cementing instead of the single plate dish liner. Consequently, explosive forging primarily involves folding of the strip at the ends and plastic stretching adjacent the center to achieve aerodynamically stable slugs. A slimmer, long length to diameter, low drag shape is the result. Consequently, our invention provides a longer standoff range capability. Additionally, simultaneous formation of several lethal slugs improves the probability that at least one of them strikes a vital spot on the target.

While the invention has been particularly shown and described with reference to a dish shaped configuration, it will be understood by those skilled in the art that various changes in form and details may be made therein without departing from the spirit and scope of the invention as defined by the appended claims.

We claim:

1. In combination with a submunition of the type wherein there is a generally cylindrical shaped case whose interior is filled with an explosive charge, the front end of said case being capped by a liner that on detonation of the explosive charge is converted into an explosively forged penetrator warhead that separates from the case and speeds towards the target, the improvement comprising:

assembling the liner from a plurality of narrow metal strips arranged in parallel and bonded together by means which are weak and crystalline with respect to the forces present on detonation of said explosive charge, said detonation causing each of said narrow metal strips to separate from adjacent strips and undergo thermally activated plastic deformation, creating thereby a plurality of aerodynamically stable slugs, all of which speed at supersonic velocity toward the target.

2. The explosively forged penetrator warhead as defined in claim 1 wherein the liner is assembled using seven metal strips arranged in parallel.

3. The explosively forged penetrator warhead as defined in claim 1 wherein the plurality of narrow metal strips are formed using soft iron.

4. The explosively forged penetrator warhead as defined in claim 1 wherein an epoxy is used to bond the plurality of metal strips together when assembling the submunition.

* * * * *